US007218707B2

(12) United States Patent
Holm

(10) Patent No.: US 7,218,707 B2
(45) Date of Patent: May 15, 2007

(54) HIGH-VOLTAGE VACUUM TUBE

(75) Inventor: Kurt Holm, Baden (CH)

(73) Assignee: Comet Holding AG, Flamatt (CH)

( * ) Notice: Subject to any disclaimer, the term of this patent is extended or adjusted under 35 U.S.C. 154(b) by 186 days.

(21) Appl. No.: 10/526,908

(22) PCT Filed: Sep. 9, 2002

(86) PCT No.: PCT/CH02/00494

§ 371 (c)(1),
(2), (4) Date: Mar. 7, 2005

(87) PCT Pub. No.: WO2004/023513

PCT Pub. Date: Mar. 18, 2004

(65) Prior Publication Data

US 2006/0165221 A1 Jul. 27, 2006

(51) Int. Cl.
*H01J 35/00* (2006.01)

(52) U.S. Cl. ..... 378/121

(58) Field of Classification Search ..... 378/9, 378/57, 119, 121, 136
See application file for complete search history.

(56) References Cited

U.S. PATENT DOCUMENTS

| | | | | |
|---|---|---|---|---|
| 2,228,384 | A | 1/1941 | Bouwers et al. | 378/142 |
| 2,332,426 | A | 10/1943 | Atlee | 378/140 |
| 4,126,803 | A | 11/1978 | Bader et al. | 378/121 |
| 4,618,977 | A | 10/1986 | Brettschneider et al. | 378/139 |
| 5,379,334 | A | 1/1995 | Zimmer et al. | 378/98.2 |
| 5,402,464 | A | 3/1995 | Schenk et al. | 378/136 |
| 5,596,621 | A | 1/1997 | Schwarz et al. | 378/130 |
| 5,725,827 | A | 3/1998 | Rhodes et al. | 264/614 |
| 6,901,136 | B1 * | 5/2005 | Tekletsadik et al. | 378/119 |

FOREIGN PATENT DOCUMENTS

| | | |
|---|---|---|
| CH | 665 920 A | 6/1988 |
| DE | 30 16 102 A | 10/1981 |
| DE | 195 16 831 A | 11/1996 |
| DE | 197 21 980 A | 10/1998 |
| DE | 198 00 766 | 7/1999 |
| GB | 1 283 287 | 7/1972 |
| GB | 1 072 536 A | 6/1997 |
| WO | WO97 07740 A | 3/1997 |

* cited by examiner

*Primary Examiner*—Courtney Thomas
(74) *Attorney, Agent, or Firm*—Reising Ethington Barnes Kisselle, P.C.

(57) ABSTRACT

High voltage vacuum tube (9) with an anode (3) and a cathode (4), the anode (3) and/or the cathode (4) being electrically insulted by means of an annular insulator (21/22). The annular insulator (21/22) is designed arched once, humped in direction of the vacuumized inner space (6), the arch having in the direction of the vacuumized inner space (6) a sloping front area (31) and two lateral areas (30/33). The sloping front area (31) of the insulator (22) of the anode (3) slopes toward the disc center (7) of the insulator (22), while the sloping front area (31) of the insulator (21) of the cathode (4) slopes away from the disc center (7) of the insulator (21).

14 Claims, 7 Drawing Sheets

HIGH-VOLTAGE VACUUM TUBE

The present invention relates to high voltage vacuum tubes in which an anode and a cathode are disposed opposite one another in a vacuumized inner space, and which vacuumized inner space is enclosed by a cylindrical metal housing, the anode and/or cathode being electrically insulated by means of an annular insulator. In particular the invention relates to high voltage vacuum tubes for use as X-ray tubes.

There are many known methods today for manufacture of X-ray tubes. X-ray tubes are used in the most various fields; thus it is no longer conceivable to do without X-ray emitters, for instance for generation of X rays for medical examinations and in the industrial sector, e.g. for x-raying baggage or transport containers at airports, at customs points, among others, and for testing facilities and structures, e.g. concrete reinforcements of bridges, etc. The reliability and life of the X-ray tubes is a decisive factor in all these applications. At the same time increasingly high demands are being made especially in the x-raying of objects. Higher performance influences the life and reliability of the tubes, however. X-ray tubes which bring the required power output usually comprise in the state of the art an anode and a cathode that are disposed opposite one another in a vacuumized inner space and that are enclosed with a cylindrical metal part. Anode and/or cathode are thereby electrically insulated by means of an annular ceramic insulator, the ceramic insulator (s) being disposed behind the anode and/or cathode and axially with respect to the metal cylinder, and terminating the vacuum space at the respective end. In their disc center the ceramic insulators have an aperture into which a high voltage lead, the anode or the cathode are inserted in a vacuum-tight way. In the state of the art, this type of X-ray tube is also designated as bipolar X-ray tube. In addition to the desired generation of X rays, other physical effects occur during operation of an X-ray tube, such as e.g. field emission, secondary electron emissions, and photoelectric effect. These effects interfere with the functioning of the X-ray tube, and can lead to impairment of the material and thereby to premature fatigue of the components. In particular, the secondary electron emission is known to interfere with X-ray tube operation. During secondary electron emission, upon impingement of the electron beam at the anode, undesired secondary electrons emerge in addition to the X rays, which undesired secondary electrons move inside the X-ray tube on paths corresponding to the field lines. Secondary electrons also arise, however, from the insulators at the anode and/or cathode being hit by unavoidable field emission electrons during operation, and triggering secondary electrons there. With switched-on high voltage at the anode and cathode, i.e. during operation of the X-ray tube, the electrical field is generated in the inner space and on surfaces adjacent to the inner space. This also includes the surfaces of the insulator. The shorter the X-ray tube is and the wider the ceramic insulator, the greater the probability that secondary electrons and/or field emission electrons impinge on the ceramic part or parts. This leads to the stability under high voltage and the life of the device being reduced in an undesirable way. With disc-shaped insulators it is therefore known in the state of the art, e.g. from DE 2855905, to use so-called shielding electrodes. The shielding electrodes can be used e.g. in pairs, which are usually disposed coaxially with a certain spacing, in the case of a rotationally symmetrical design of the X-ray tube, in order to optimally prevent the propagation of the secondary electrons. As has been shown, such apparatuses can no longer be used at very high voltage, however. Moreover the material and production cost with such constructions is higher than with X-ray tubes with just insulators. Another possibility in the state of the art is shown e.g. in DE 6946926. In these solutions, a conical ceramic insulator is used, in order to reduce the surface acted upon. The ceramic insulator has a substantially constant wall thickness, and is covered e.g. with a rubber layer applied by vulcanization. As mentioned, the electrical field inside the vacuum space also encompasses the surfaces of the insulators. In particular with conical insulators, an electron hitting the insulator or a stray electron triggered by a hitting electron is accelerated in the direction of the anode by the field. In so doing, a single electron will hardly cause a malfunction. If the anode-side insulator as well as the cathode-side insulator are designed as a frustum projecting into the inner space, then an electron hitting the insulator (for instance one released from the metal envelope) will likewise be accelerated toward the anode. On the anode side it moves however along the insulator surface because there exists no electrical field pointing away from the insulator surface. After passing through a certain stretch, such an electron has enough energy to trigger other electrons, which, in turn, again trigger electrons, so that it results in an electron avalanche running on the insulator surface toward the anode, which electron avalanche can cause considerable interference, depending upon the circumstances also gas eruptions or even a snapping of the insulator. The higher the voltage, the more significant this effect becomes. Therefore, at very high voltages, this type of insulator can no longer be used. This effect occurs less cathode-side since electrons which reach the insulator surface cathode-side, or are released therefrom, move through the vacuum in the direction of the metal cylinder and not along the insulator surface. In the state of the art different solutions are known for avoiding the disadvantage at the anode part. Proposed in the publication DE 2506841, unexamined with respect to substance, for example, is that the insulator cathode-side be designed such that a conical cavity is formed between the insulator and the tube. Another solution of the state of the art is shown e.g. in the patent publication EP 0 215 034, where the disc-shaped insulator is graduated toward the metal cylinder in a step-like way. Another solution of the state of the art is shown in the patent publication U.S. Pat. No. 5,402,464, where the insulator is design trapezoidal and is divided by a curved metal sleeve into an inner and an outer part. A further solution of the state of the art is shown in the patent publication DE 19800766, where the insulator comprises inclinations running in opposite directions, and is divided by a metal sleeve into an inner and outer part.

It has been demonstrated, however, that all the solutions shown in the state of the art have operational faults at high voltages, i.e. for instance over 150 kV, which lead to a premature aging of the material, among other things, and can cause gas eruptions and/or snapping of the insulator. Thus for many modern applications of X-ray tubes at very high voltages (>200 kV) the insulators known in the state of the art are only poorly usable.

It is an object of this invention to propose new insulators for high voltage vacuum tubes and a method for producing such insulators which do not have the drawbacks described above. In particular a long life and a failure-free operation operation should be ensured also at very high voltages with small or compact construction. The high voltage vacuum tubes are intended, among other things, for use as X-ray tubes for x-raying baggage and/or transport containers, etc., and should meet the industrial demands necessary there.

These objects are achieved according to the present invention in particular through the elements of the independent claims. Further preferred embodiments follow moreover from the dependent claims and from the specification.

In particular these objects are achieved in that in a high voltage vacuum tube an anode and a cathode are disposed opposite one another in a vacuumized inner space, in that the vacuumized inner space is enclosed by a cylindrical metal housing, and in that the anode and/or the cathode are electrically insulated by means of an annular insulator, the annular insulator comprising a cylindrical part having a curved humped arch in direction of the vacuumized inner space, the arch comprising in direction of the vacuumized inner space a front area sloping with respect to the axis of symmetrical rotation of the annular insulator, and two lateral areas, the sloping front area of the annular insulator of the anode being sloping toward the disc center of the annular insulator, and the sloping front area of the annular insulator of the cathode being sloping away from the disc center of the annular insulator. The arch is characterized substantially by angles $\alpha$, $\beta$, and $\gamma$ of a shortened lateral area, of a raised lateral area, and of the front area, the angle $\alpha$ between the axial direction of the annular insulator and the raised lateral area being between 10° and 25°, and the angle $\beta$ of the front area to the perpendicular to the axial direction of the annular insulator being between 10° and 25°, and the angle $\gamma$ between the shortened lateral area to the axial direction of the annular insulator being between 10° and 25°. In particular the insulator(s) according to the invention can be designed alternatively either cathode-side only, or anode-side only, or on both sides, i.e. on the side of the anode and on the side of the cathode. One lateral area each of an insulator slopes toward the respective negative electrode, and runs over a larger region in its vicinity. At the anode, the wall of the cylindrical metal housing forms the negative electrode with respect to the insulator, while at the cathode the metallic outer wall of the cathode forms the negative electrode with respect to the insulator. The connection point between the respective negative electrode and the corresponding insulator is designated as the negative triple point. The high voltage vacuum tube can be used e.g. as an X-ray tube. The above-mentioned design has the advantage that during operation an extraordinarily high stability of the tube is achieved through the arising electrical field, without resulting in breakthroughs in the insulator anode-side and/or cathode-side, gas eruptions and/or other malfunctions At the same time the tube can be operated at much higher voltages and with smaller or respectively more compact construction than conventional tubes. The dimensions of the tube and the voltage at the insulator are in a direct relationship to one another. The smaller the construction, the greater the insulator's capability must be to withstand voltage at the electrode. The advantages of a smaller and more compact construction for such tubes are evident. Smaller and more compact tubes are cheaper to produce, are less heavy, and easier to handle. This especially concerns e.g. any necessary lead shielding, etc. Achieved through the special form of the insulator is that a critical part of the tube is electrically shielded, namely the negative triple point, at which, as mentioned, the negative metal electrode, the ceramic and the vacuum come together, and which promotes in particular the emission of electrons. The emission of electrons is thereby inhibited. On the cathode-side this triple point is located in the soldered technical connection between the insulator and the high voltage supply in the center of the insulator. On the anode side, on the other hand, the triple point is situated in the soldered technical connection between the outer periphery of the insulator and the cylindrical metal housing. The shielding takes place through a forced charging of the ceramic in the vicinity of the negative triple point by emitted electrons. Through the shaping of the insulator, a very high field is initially created in the region of the triple point, sufficing already at lower voltages (e.g. during a start-up phase in the operation of the tube) to release electrons from the metal. These electrons charge the ceramic to such an extent that the electrical field in this region is reduced such that the electron emission is disrupted. The special shape of the insulator prevents the electrons from being able to reach the positive counter electrode via the ceramic or through the vacuum. The condition is thereby stabilized. Achieved in addition, by means of the sloping front side, is that electrons which are released from the negative metallic electrode at higher voltage outside the above-mentioned region reach the positive electrode directly through the vacuum, and are not accelerated on the ceramic surface. An avalanche-like multiplication of the free electrons and with it an intense sparking over by secondary electrons over the ceramic surface is thereby prevented. Thus through the unusual shape of the insulator the capability to withstand voltage and the life of the vacuum tube can be significantly increased.

In an embodiment variant, the arch is substantially characterized by angles $\alpha$, $\beta$ and $\gamma$ of a shortened lateral area, of a raised lateral area, and of a front area, the angle $\alpha$ between the axial direction of the annular insulator and the raised lateral area being between 10° and 25°, and the angle $\beta$ of the front area to the perpendicular to the axial direction of the annular insulator being between 10° and 25°, the angle $\gamma$ between the shortened lateral area to the axial direction of the annular insulator being between 10° and 25°. The three areas can each have a tangential transition radius of 1 to 7 mm. This embodiment variant has, among other things, the same advantages as the preceding embodiment variant. In particular high voltage vacuum tubes can thereby be operated with voltages of more than 200 kV at the insulator, without resulting in malfunctions or failures through secondary electrons. Such tubes with the mentioned voltage can be constructed having maximal diameters of the insulators of 150 mm, which brings the mentioned advantages with respect to production and transport costs, etc., weight and manageability.

In another embodiment variant, the annular insulator comprises a fourth region between the raised lateral area and the front area, sloping with respect to the perpendicular to the axial direction of the annular insulator, which fourth area points substantially perpendicularly to the axis of the annular insulator in the direction of the vacuumized inner space, and which has a tangential transition radius of 1 to 7 mm to the raised lateral area as well as to the front area. This embodiment variant has, among other things, the same advantages as the preceding embodiment variant. In particular, high voltage vacuum tubes can thereby be operated with voltages of more than 200 kV at the insulator, without resulting in malfunctions or failures through secondary electrons.

In a further embodiment variant, the raised lateral area projects into the vacuumized inner space at least twice as far as the shortened lateral area. This embodiment variant has, among other things, the advantage that the sloping of the front surface away from the negative electrode is so great that no secondary electrons can be generated on the ceramic surface through auto-emission of the negative electrode. Prevented in this way are intense discharges which can lead to permanent damage at the insulator.

In an again different embodiment variant, the raised lateral area has a tapering termination toward the axial direction of the annular insulator, and/or the shortened lateral area has a tapering termination toward the axial direction of the annular insulator. This embodiment variant has, among other things, the advantage that the electrical field can be minimized at the soldering points for fixing the annular insulator at the anode or cathode or respectively at the cylindrical metal housing.

In a further embodiment variant, the annular insulator is substantially composed of an insulating ceramic material. The ceramic material can consist e.g. of at least 95% $Al_2O_3$. This embodiment variant has, among other things, the advantage that the ceramic material is especially suitable as an insulator with the very high electrical fields, in terms of its stability against voltage or snapping.

In an embodiment variant, the cathode includes an electro-polished and/or mechanically polished metal cylinder on the outer wall facing the annular insulator. This has, among other things, the advantage that the capability to withstand voltage can be increased, and snapping can be prevented.

In an embodiment variant, the high voltage vacuum tube 9 comprises a power supply device, by means of which operational voltages of at least 200 kV are able to be applied at the insulator. This embodiment variant has, among other things, the advantage that it can provide the required power for special applications in industry, such as e.g. x-raying of transport containers at customs points and airports, etc.

It should be stated here that, in addition to the method according to the invention, the present invention also relates to a system for carrying out this method.

Embodiment variants of the present invention will be described in the following with reference to examples. The examples of the embodiments are illustrated by the following attached figures:

FIG. 1 shows a block diagram representing schematically a cross section of an X-ray tube of the state of the art. The annular insulator 10 is thereby designed graduated in a step-like way 101 facing the cylindrical metal housing 1, as well as facing the electrode 2 in order to reduce the generation of secondary electrons.

FIG. 2 shows a block diagram representing schematically a cross section of another design of an X-ray tube of the state of the art. Toward the cylindrical metal housing 1 the annular insulator 11 thereby displays a raised part 110 with a depression 111 at the transition to the metal housing 1.

FIG. 3 shows a block diagram representing schematically a cross section through another design of an X-ray tube of the state of the art. Toward the cylindrical metal housing 1 the annular insulator 12 thereby displays a raised part 120 with a depression 121 at the transition to the metal housing 1. At the level of the raised part 120 the metal housing 1 thereby bulges outward radially 122.

FIG. 4 shows a block diagram representing schematically a cross section of an X-ray tube similar to that of FIG. 1 of the state of the art. Facing the cylindrical metal housing 1 as well as facing the electrode 2, the annular insulator 14 is thereby graduated in a simple step-like way in each case, in order to prevent the generation of secondary electrons. As can be seen from the representation, the annular insulator 14 is identical on the side of the anode 3 and of the cathode 4. Between anode 3 and cathode 4 there is an electron aperture or diaphragm 5 in order to further reduce possible stray electrons.

FIG. 5 shows a block diagram representing schematically a cross section of a further design for an X-ray tube of the state of the art. The insulator 15 is thereby constructed conically at the walling of the support of the electrode 2 (anode or cathode). At the same time the cylindrical metal housing 1 tapers toward the electrode. Such designs are no longer suitable for high voltages since at high voltages they become instable with respect to secondary electrons.

FIG. 6 shows a block diagram representing schematically a cross section of an embodiment of an X-ray tube according to the invention. The annular insulator is designed hump-shaped with the characterizing angles α, β and γ. The anode-side insulator 22 has a front surface 31 sloped toward the anode 3, whereas the cathode-side insulator 21 has a front surface 31 pointing toward the cylindrical metal housing.

Figure 9:
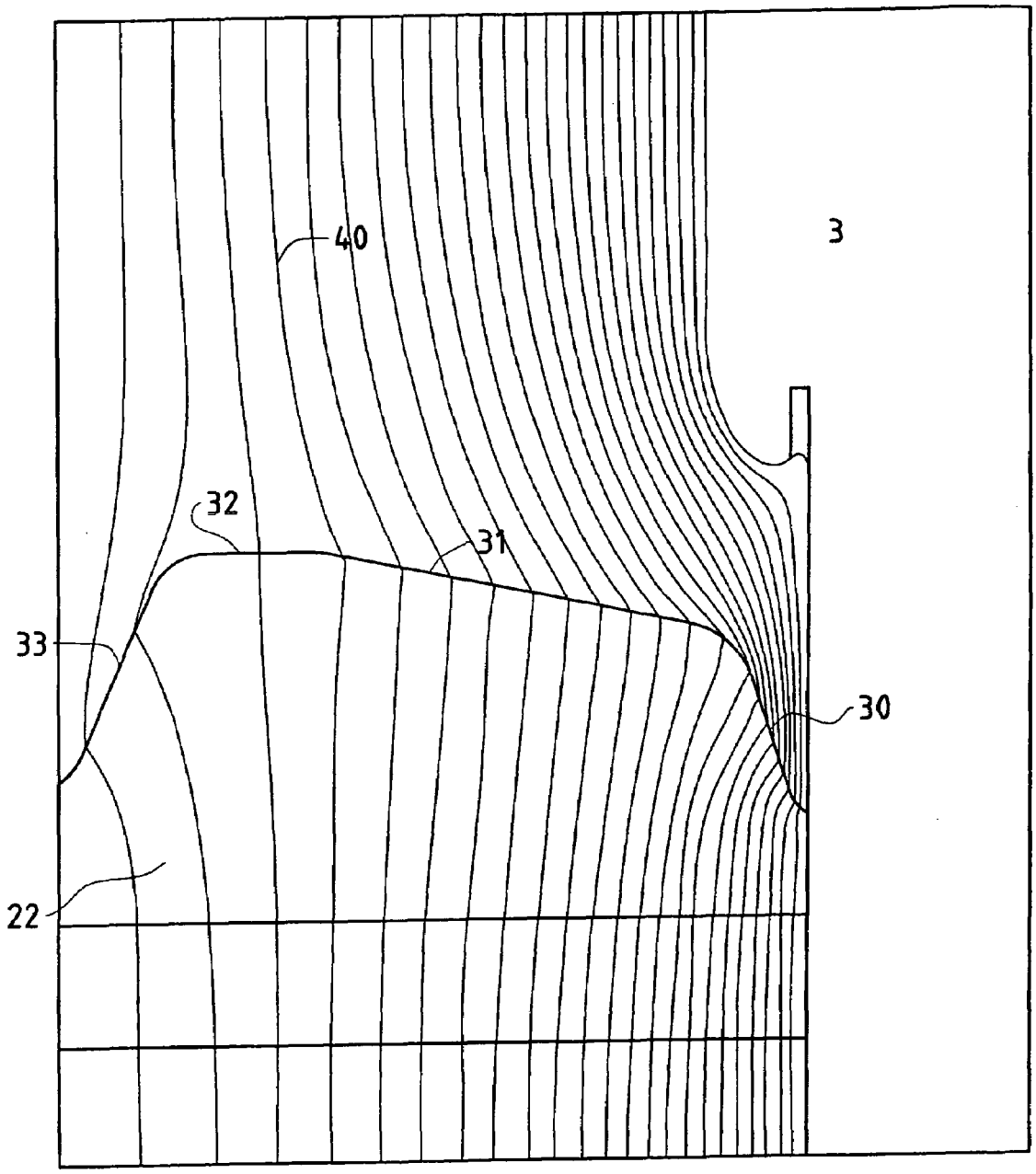

FIG. 9 shows a block diagram representing schematically the course of the equipotential lines 40 on sides of the anode 3 with applied operational voltage. The hump shape of the insulator 22 influences the course of the field lines 40 in such a way that a field superelevation takes place on sides of the cylindrical metal housing at the lower part of the surface 33, which releases electrons from the cylindrical metal housing. These electrons charge the ceramic such that a nearly field-free space is created in this lower part.

Figure 10:
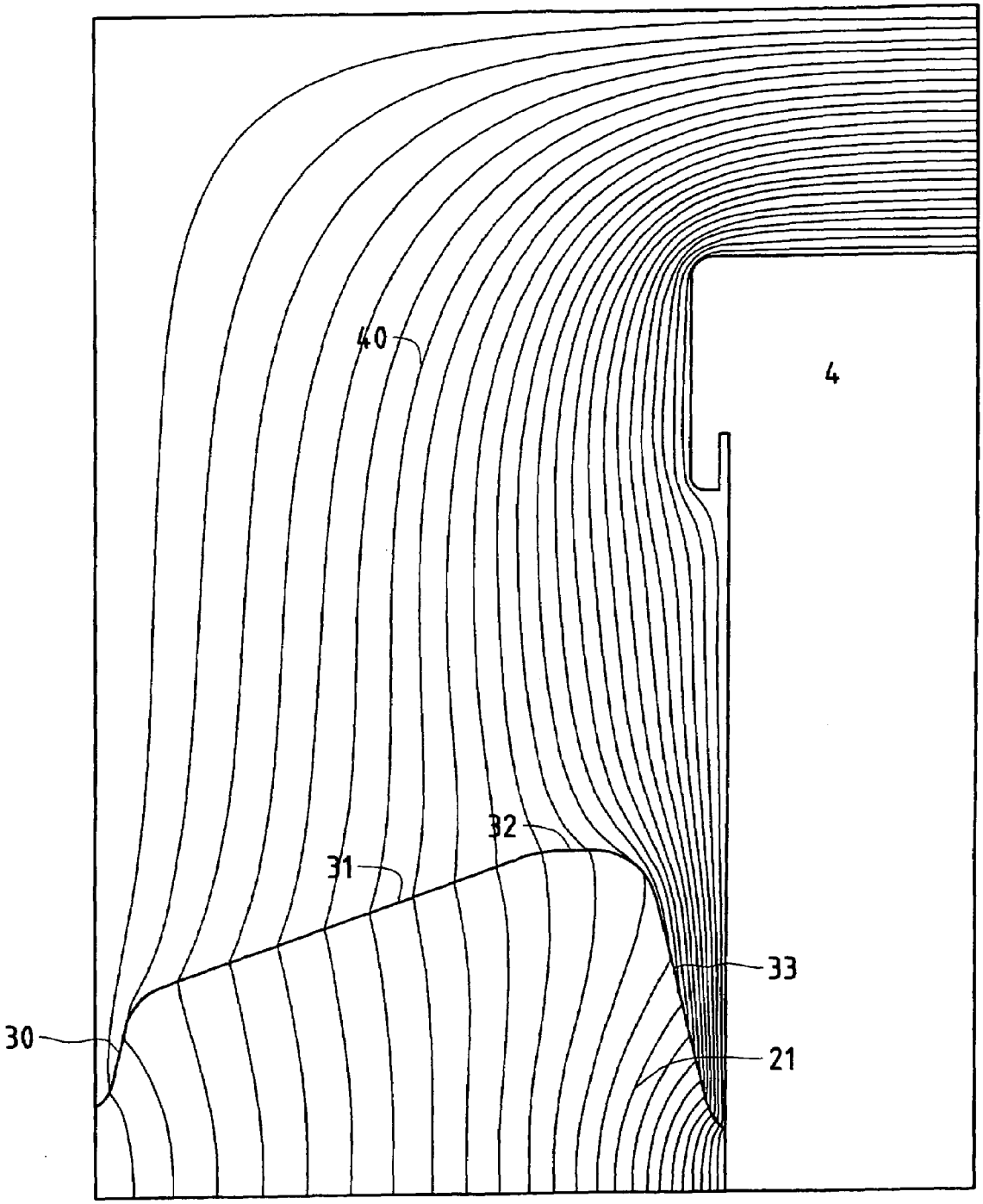

FIG. 10 shows a block diagram representing the course of the equipotential lines 40 on sides of the cathode 4 with applied operational voltage. Anode-side, the hump shape of the insulator 21 is designed mirrored to the cathode-side insulator. The hump shape of the insulator 21 influences the course of the field lines 40 in such a way that a field superelevation takes place on sides of the cathode 4 at the lower part of the surface 33, which releases electrons from the metal electrode. These electrons charge the ceramic such that a nearly field-free space is created in this lower part.

Figure 6:
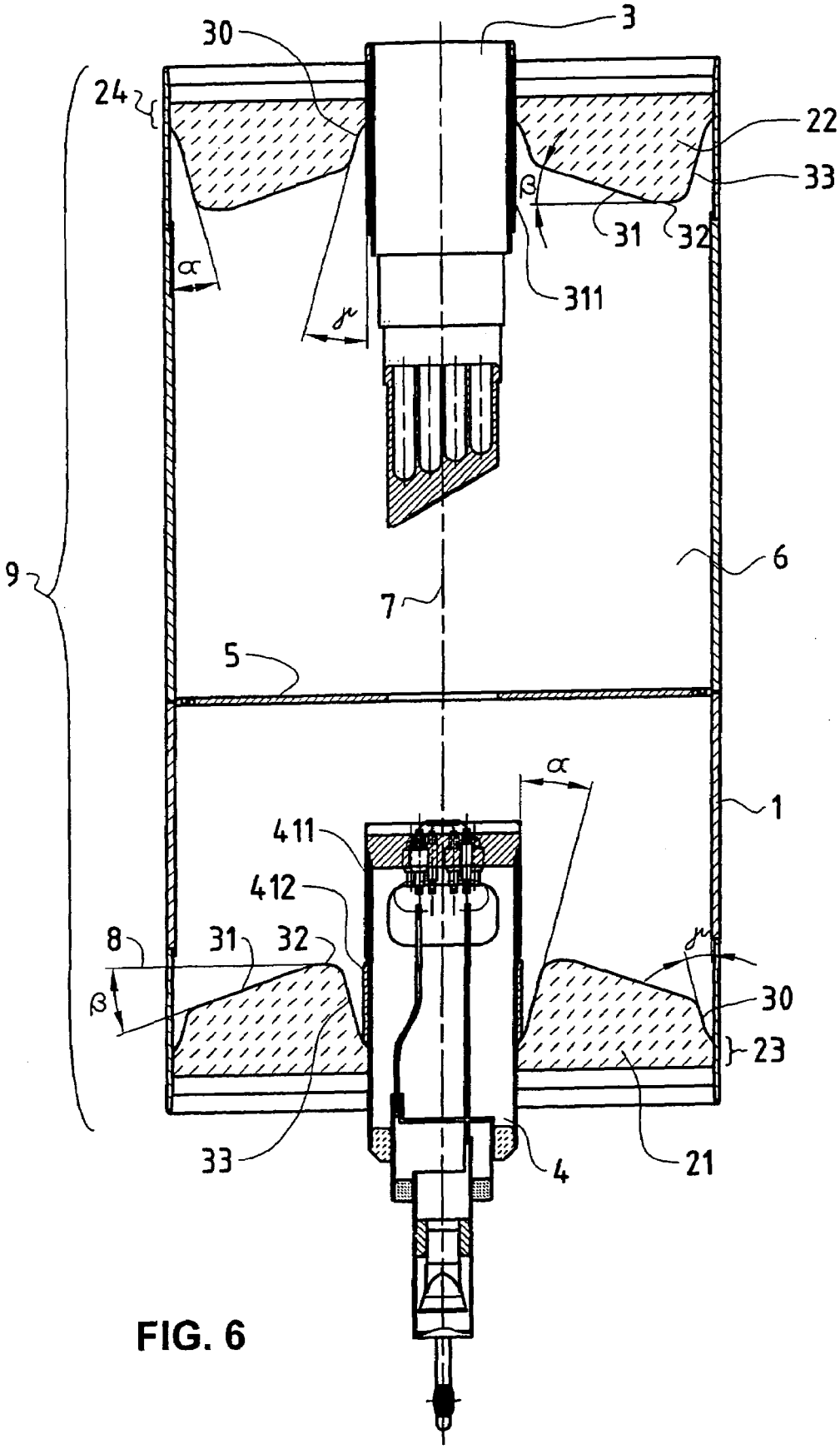
Figure 7:
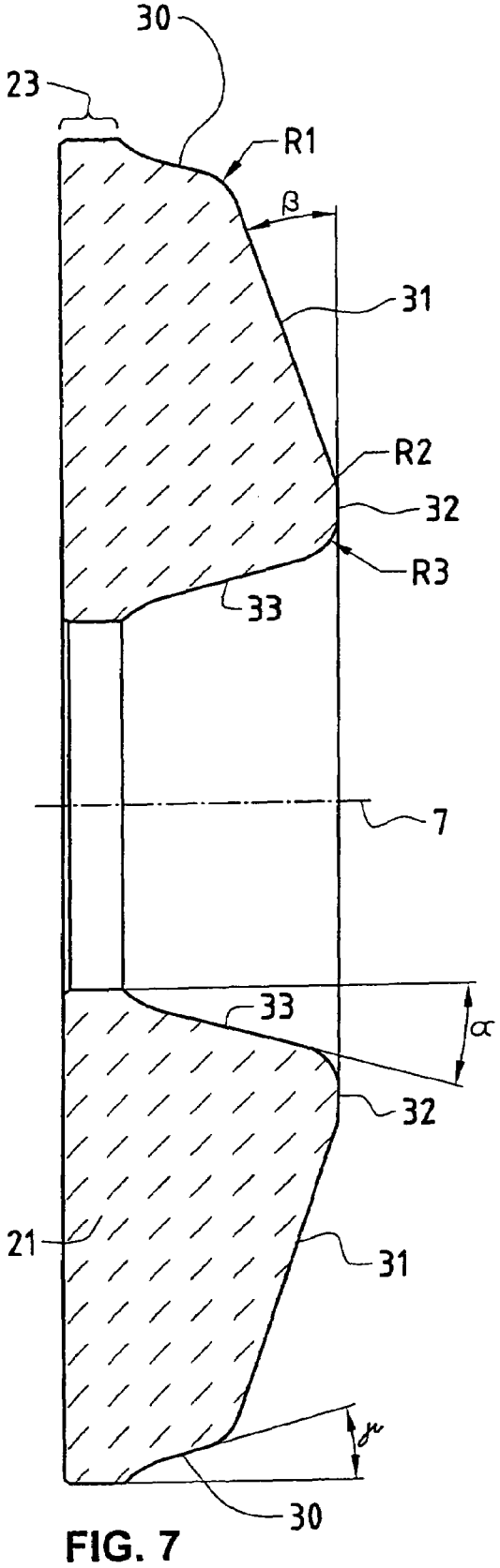
FIG. 7 shows a block diagram representing schematically a cross section of a cathode-side annular insulator 21 according to the invention. The insulator is designed hump-shaped with the characterizing angles α, β and γ.
Figure 8:
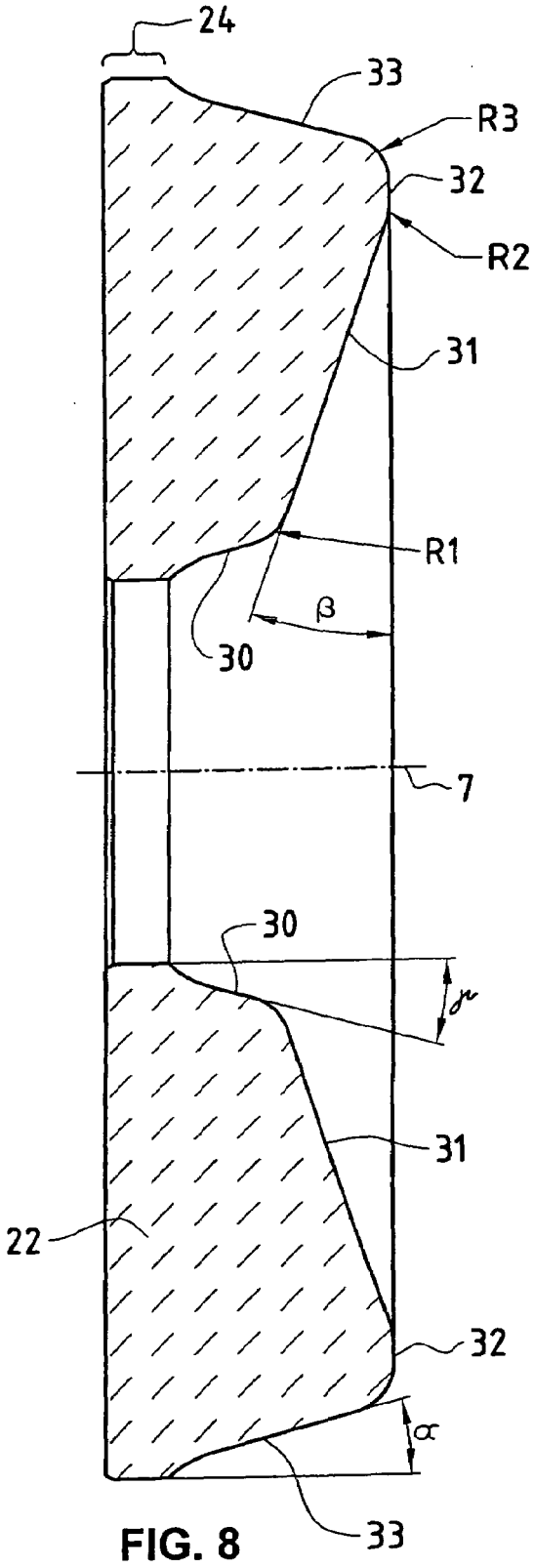
FIG. 8 shows a block diagram representing schematically a cross section of an anode-side annular insulator 21 according to the invention. The insulator is designed hump-shaped with the characterizing angles α, β and γ.

FIG. 6, FIG. 7 and FIG. 8 illustrate a high voltage vacuum tube or respectively a method for a high voltage vacuum tube as can be used in achieving the invention. Same reference numerals in the figures designate same elements. In this embodiment example an anode 3 and a cathode 4 are disposed opposite each other in a vacuumized inner space 6. The vacuumized inner space 6 is enclosed by a cylindrical metal housing 1. The cylindrical metal housing 1 can have e.g. a minimal wall thickness of 2 mm. It is likewise conceivable for the cylindrical metal housing 1 to be electro-polished or mechanically polished facing the vacuumized inner space 6. The anode 3 and/or the cathode 4 are electrically insulated by means of an annular insulator 21/22. FIG. 7 and FIG. 8 show a detailed representation of an annular insulator 21/22 in section, FIG. 7 showing the annular insulator 21 cathode-side, and FIG. 8 the annular insulator 22 anode-side. The annular insulator 21/22 can be substantially composed of an insulating ceramic material, for instance. Conceivable as the ceramic material is e.g. ceramic material of at least 95% $Al_2O_3$. For example, a single or multiple layer of an alloy can sintered on the ceramic. The alloy can comprise e.g. a MoMnNi alloy. The arithmetic average surface finish ($R_a$) of the annular ceramic insulator can amount e.g. to about 1.6 μm. It is also possible, however, for the annular ceramic insulator to be smooth or mechanically polished. A pressing pressure of at least 1000 bar can be used to produce such an annular insulator 21/22, for example. The annular insulator 21/22 has a cylindrical part 23/24, and is designed arched once, humped in the direction of the vacuumized inner space 6. The arching in the direction of the vacuumized inner space 6 comprises a sloping front area 31 and two lateral areas 30/33. The sloping front area 31 of the annular insulator 22 of the anode 3 slopes towards the axis through the disc center 7 of the insulator 22, while the sloping front area 31 of the annular insulator 21 of the cathode 4 slopes away from the axis through the disc center 7 of the annular insulator 21. The arch can be characterized substantially e.g. by the angles α, β and γ of a shortened lateral area 30, of a raised lateral area 33, and of a front area 31. The angle α between the axial direction 7 of the annular insulator 21/22 and the shortened lateral area 30 is preferably between 10° and 25°, and the angle β of the front area 31 to the perpendicular 8 to the axial direction 7 of the annular insulator 21/22 is preferably between 10° and 25°. The angle γ between the raised lateral area to the axial direction 7 of the annular insulator 21/22 finally is preferably between 10° and 25°. The three areas 30/31/33 can each have a tangential transition radius R1/R3 of e.g. 3 to 7 mm. In relation to the shortened lateral area 30, the raised lateral area 33 projects into the vacuumized inner space 6 e.g. at least twice as far as the shortened lateral area 30. The front surface of the insulator is thereby sloped such that it cannot be hit by electrons from the negative electrode. On the cathode side the negative triple point is located in the soldered technical connection between the insulator 21 and the high voltage supply in the center of the annular insulator, i.e. of the outer wall 411 of the cathode 4. On the anode side, on the other hand, the negative triple point is situated in the soldered technical connection between the outer periphery of the annular insulator 22 and the cylindrical metal housing 1. Therefore the outer wall 311 of the anode is less critical with respect to the mentioned electron effects. The cathode 4 can have an electro-polished and/or mechanically polished metal cylinder 412 on its outer wall 411 facing the annular insulator 21. Through the unusual shape of the insulator 21/22 the capability to withstand voltage and the life of the vacuum tubes can be significantly increased. FIG. 9 and FIG. 10 show a possible course of the equipotential lines 40 on sides of the anode 3 or respectively on sides of the cathode 4 with applied operational voltage. The hump shape of the insulator 21/22 influences the course of the field lines in such a way that a region of higher field intensity is initially created on sides of the raised area at the lower part of the surface 33. Electrons are thereby released from the adjacent metal electrode, which charge the ceramic in this region electrostatically. The charging reduces the electrical field in this region. A further electron emission is thereby prevented, and the high voltage behavior of the tube improved in a lasting way. In an embodiment variant, the annular insulator 21/22 includes a fourth region 32 between the raised region 33 and the front region 31 sloped with respect to the axial direction 7 of the annular insulator 21/22. This fourth region 32 stands substantially perpendicular 8 to the axis 7 of the annular insulator 21/22 in direction of the vacuumized inner space 6. The fourth region 32 can have e.g. a tangential radius R2/R3 of 3 to 7 mm with respect to the raised area 33 as well as to the front area 31. As a further embodiment variant, it can be advantageous, for example, for the raised area 33 and/or the shortened area 30 to have a tapering termination toward the axial direction 7 of the annular insulator 21/22. If the high voltage vacuum tube 1 includes a power supply device by means of which operational voltages of at least 200 kV are able to be applied at the insulator, then the high voltage vacuum tube 1 can be especially suitable for special applications in industry, such as e.g. x-raying of transport containers at customs points and airports, etc. with the power required there. The high voltage vacuum tube 1 can be used in particular as an X-ray tube in this application. It is clear that the high voltage vacuum tube 1 according to the invention is suitable in particular for use as an X-ray tube in any application.

It is important to point out that a high voltage vacuum tube 9 does not necessarily have to include the insulator 21/22 according to the invention on both sides, i.e. at the anode 3 and at the cathode 4. On the contrary, it is absolutely possible for the insulator 21/22 to be present only at one of the electrodes 3/4, while the other electrode 3/4 has a differently shaped insulator or none at all. Depending upon the configuration of the high voltage vacuum tube 9, it can also make sense, for instance, to add an electron aperture or diaphragm 5 to reduce secondary electrons in the device. It is to be added furthermore that the X-ray tube according to the invention is suited in particular for use in a baggage x-raying device. Especially x-raying devices for transport containers and/or transport vessels, with their high requirement in radiation power, are among the ideal areas of application for the high voltage vacuum tubes or respectively X-ray tubes according to the invention.

Figure 1:
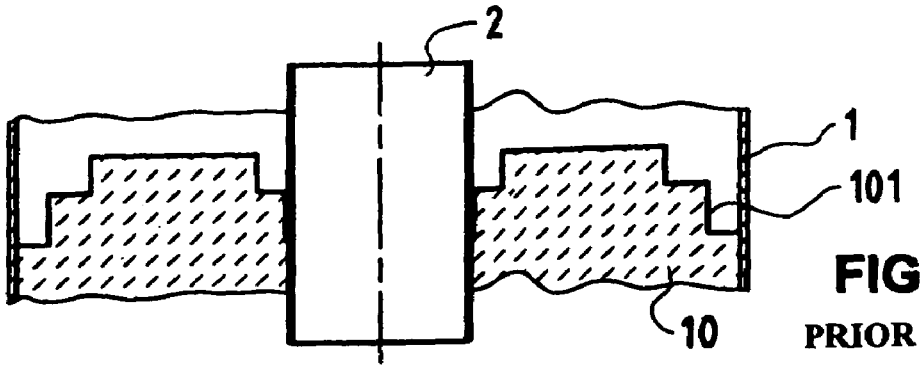
FIG. 1 PRIOR ART
Figure 2:
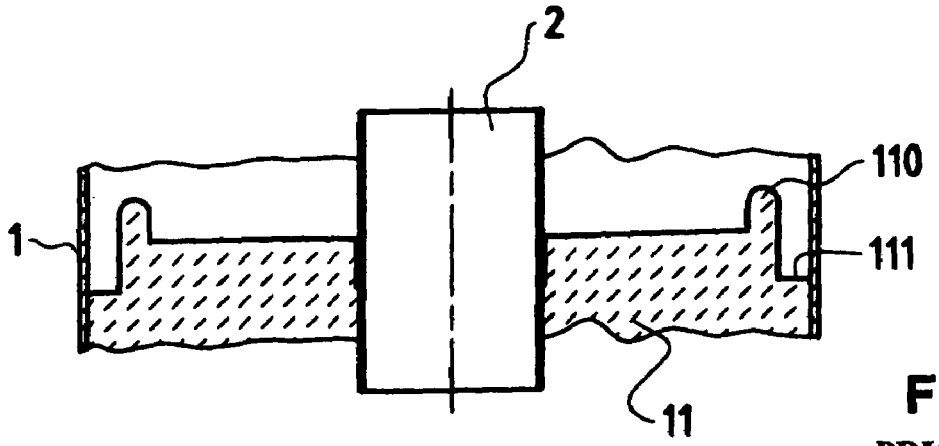
FIG. 2 PRIOR ART
Figure 3:
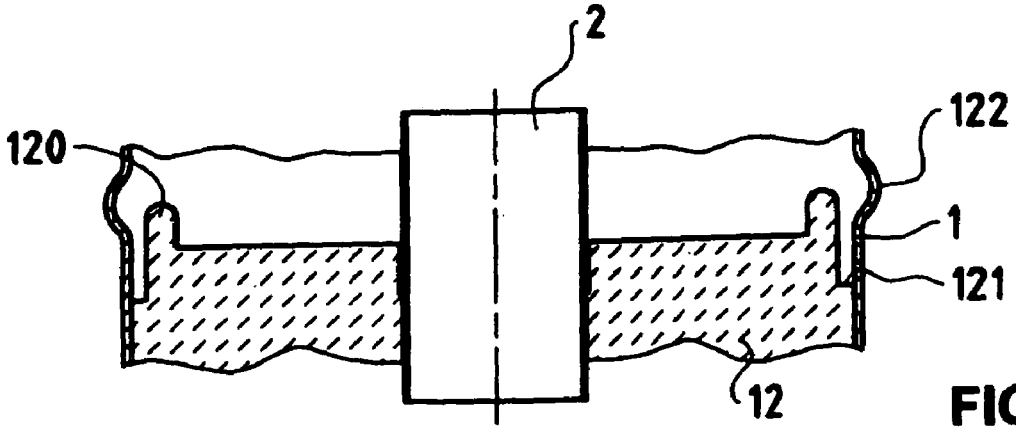
FIG. 3 PRIOR ART
Figure 4:
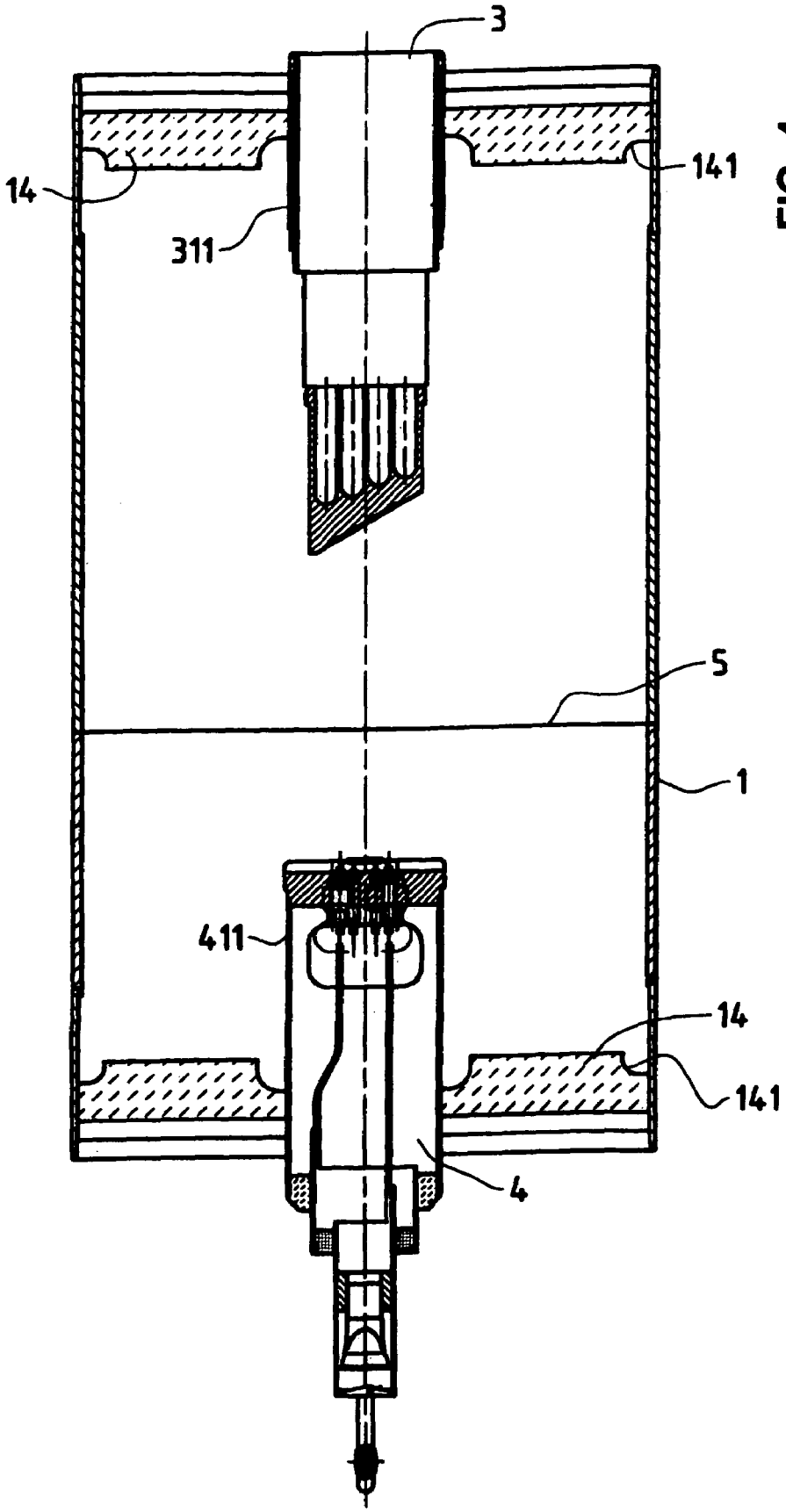
FIG. 4 PRIOR ART
Figure 5:
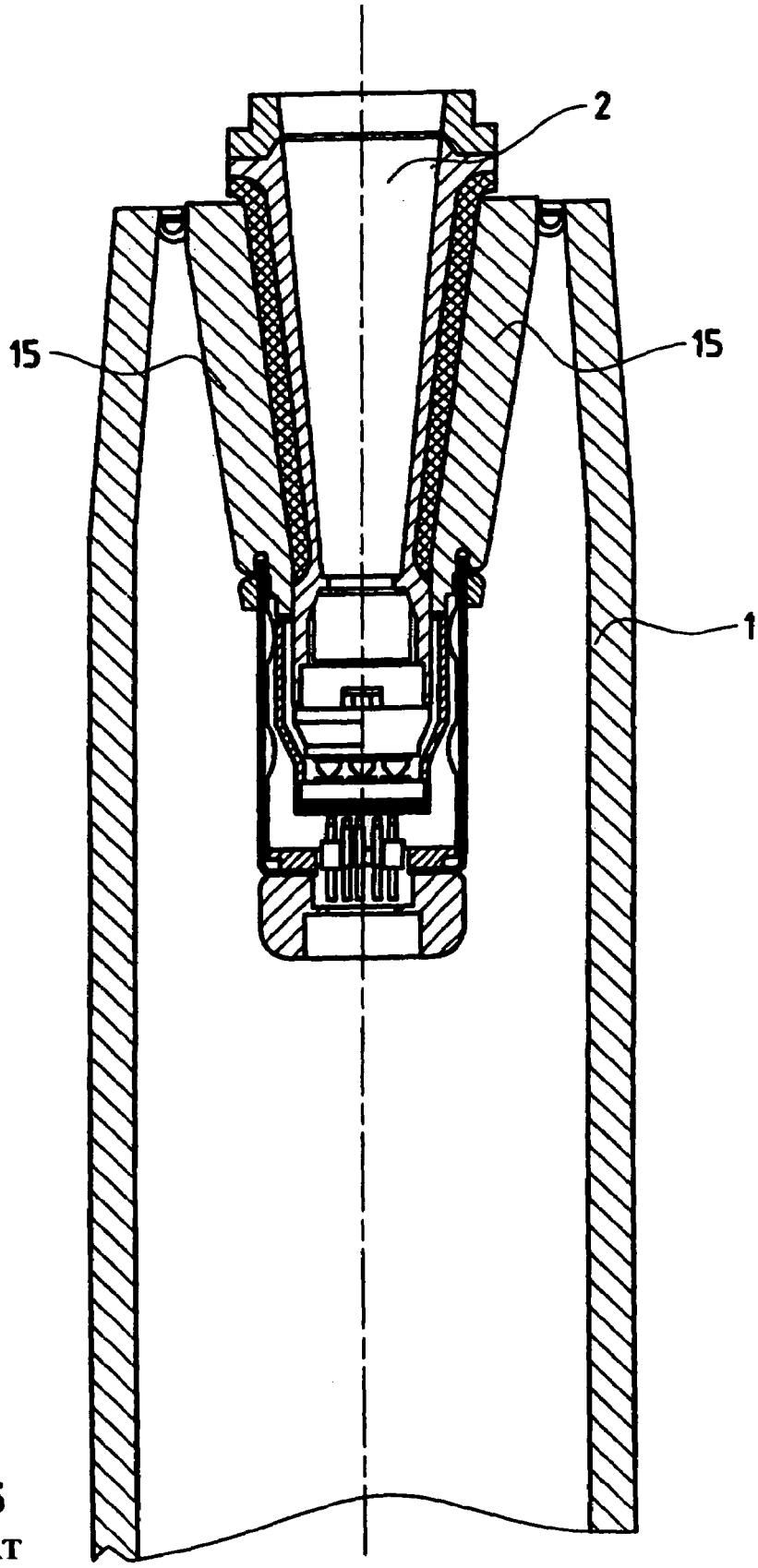
FIG. 5 PRIOR ART

FIGS. 1 to 4 show schematically examples of X-ray tubes of the state of the art. The annular insulators 10/11/12/14 thereby are graduated toward the cylindrical metal housing 1 and/or toward the electrode 2 in a step-like manner 101, with raised part 110/120 and/or simple or multiple depressions 111/121/141 and/or bulges 122. As can be seen from the depictions, the annular insulator 14 is identical in each case on the side of the anode 3 and of the cathode. An electron aperture or diaphragm 5 can be situated between anode 3 and cathode 4 in order to further reduce possible stray electrons. FIG. 5 shows a further design of an X-ray tube of the state of the art. The insulator 15 is thereby conically constructed at the walling of the support of the electrode 2 (anode or cathode). At the same time the cylindrical metal housing 1 tapers toward the electrode. In particular, such designs are no longer suitable for high voltages since at high voltages they become instable against secondary electrons.

The invention claimed is:

1. A high voltage vacuum tube, in which an anode and a cathode are disposed opposite one another in a vacuumized inner space and which vacuumized inner space is enclosed by a cylindrical metal housing, the anode and/or the cathode being electrically insulated by means of an annular insulator, the annular insulator having a cylindrical part, with a curved humped arch in direction of the vacuumized inner space, comprising:

in direction of the vacuumized inner space, a sloping front area, a shortened lateral area and a raised lateral area, the arch being characterized substantially by angles α, β and γ of the raised lateral area, of the front area and of the shortened lateral area, wherein said sloping front area of the annular insulator with an anode-side design slopes toward a disc center of the annular insulator, or respectively with cathode-side design away from the disc center of the annular insulator, wherein the angle γ between an axial direction of the annular insulator and the shortened lateral area is between 10° and 25°, wherein the angle β of the front area to a perpendicular to the axial direction of the annular insulator is between 10° and 25°, and wherein the angle a between the raised lateral area to the axial direction of the annular insulator is between 10° and 25°.

2. The high voltage vacuum tube according to claim 1, characterized in that the three areas each have a tangential transition radius (R1/R3) of 1 to 7 mm.

3. The high voltage vacuum tube of claim 1 wherein the annular insulator has a fourth area between the raised lateral area and the front area, sloping with respect to the perpendicular to the axial direction of the annular insulator, which fourth area points substantially perpendicularly to the axis of the annular insulator in the direction of the vacuumized inner space, and which has a tangential transition radius (R2/R3) of 1 to 7 mm to the raised lateral area as well as to the front area.

4. The high voltage vacuum tube of claim 1 wherein the raised lateral area projects into the vacuumized inner space at least twice as far as the shortened lateral area.

5. The high voltage vacuum tube of claim 1 wherein the raised lateral area has a tapering termination toward the axial direction of the annular insulator.

6. The high voltage vacuum tube of claim 1 wherein the shortened lateral area has a tapering termination toward the axial direction of the annular insulator.

7. The high voltage vacuum tube of claim 1 wherein the annular insulator is substantially comprised of an insulating ceramic material.

8. The high voltage vacuum tube of claim 7, wherein the ceramic material of the annular insulator is comprised of at least 95% $Al_2O_3$.

9. The high voltage vacuum tube of claim 1 wherein the cathode comprises an electro-polished and/or mechanically polished metal cylinder on the outer wall facing the annular insulator.

10. The high voltage vacuum tube of claim 1 wherein the high voltage vacuum tube comprises a power supply device, by means of which operational voltages of at least 200 kV are able to be applied at the insulator.

11. The high voltage vacuum tube of claim 1 wherein the high voltage vacuum tube is an X-ray tube.

12. A method of producing a high voltage vacuum tube of claim 1, characterized in that a pressing power of at least 1000 bar is used to produce the annular insulator.

13. A baggage x-raying device, comprising a device for generation of X rays, the device for generation of X rays comprising at least one power supply device by means of which operational voltages of at least 200 kV are able to be generated, and at least one X-ray tube of claim 1.

14. An x-raving device for transport containers and/or transport vessels, comprising at least one X-ray tube of claim 1 for generating X rays.

* * * * *

UNITED STATES PATENT AND TRADEMARK OFFICE

CERTIFICATE OF CORRECTION

PATENT NO. : 7,218,707 B2
APPLICATION NO. : 10/526908
DATED : May 15, 2007
INVENTOR(S) : Kurt Holm It is certified that error appears in the above-identified patent and that said Letters Patent is hereby corrected as shown below:

In the Specification:

Col. 2, Line 63 After "failure-free operation", delete "operation"

In the Claims:

Claim 1, Col. 9, Line 1 After "angle", delete "a", insert --α--

Signed and Sealed this

Twenty-fourth Day of August, 2010

David J. Kappos

David J. Kappos
*Director of the United States Patent and Trademark Office*